US006520548B1

(12) United States Patent
Fisher et al.

(10) Patent No.: US 6,520,548 B1
(45) Date of Patent: Feb. 18, 2003

(54) VEHICLE DOOR LATCH

(75) Inventors: Sydney Edward Fisher, Solihull (GB); Gurbinder Singh Kalsi, Warley (GB)

(73) Assignee: ArvinMeritor Light Vehicle Systems (UK) Limited, Birmingham (GB)

( * ) Notice: Subject to any disclaimer, the term of this patent is extended or adjusted under 35 U.S.C. 154(b) by 0 days.

(21) Appl. No.: 09/424,570

(22) PCT Filed: May 12, 1998

(86) PCT No.: PCT/GB98/01347

§ 371 (c)(1),
(2), (4) Date: Feb. 24, 2000

(87) PCT Pub. No.: WO98/53165

PCT Pub. Date: Nov. 26, 1998

(30) Foreign Application Priority Data

May 23, 1997 (GB) ..... 9710602

(51) Int. Cl.[7] ..... E05C 3/06
(52) U.S. Cl. ..... 292/201; 49/280
(58) Field of Search ..... 292/201, 216, 292/DIG. 23; 49/280

(56) References Cited

U.S. PATENT DOCUMENTS 3,688,332 A * 9/1972 Bellware ..... 15/250.16
4,173,055 A * 11/1979 Izumi ..... 15/250.02
4,892,339 A * 1/1990 Kleefeldt ..... 292/201
4,986,579 A * 1/1991 Ishikawa ..... 292/201
5,273,324 A 12/1993 Kobayashi
5,288,115 A 2/1994 Inoue et al.
5,564,761 A 10/1996 Mizuki et al.
5,639,130 A * 6/1997 Rogers ..... 292/216
5,769,468 A * 6/1998 Armbruster ..... 292/201
5,944,367 A * 8/1999 Imaizumi ..... 292/201

FOREIGN PATENT DOCUMENTS

DE 4107219 9/1992
EP 0397966 11/1990

* cited by examiner

*Primary Examiner*—Gary Estremsky
(74) *Attorney, Agent, or Firm*—Wood, Phillips, Katz, Clark & Mortimer

(57) ABSTRACT

Vehicle door latch assembly includes power closing mechanism (FIG.1) for driving a latching claw 10 from an outer position at which it has engaged a coacting striker 14 for hold the related door at first-safety position to an inner position drawing the door to fully closed position, the claw being retained at either position by a conventional latching pawl 16 selectively releasable by unlatching means 20. The closing mechanism includes a drive pawl 24 pivoted on a powered drive lever 22 to turn the claw to the inner position, a disabling rocker 36 coupled to the arm latching means preventing engagement of the drive pawl when the latching pawl is disengaged so that release of the closed door is not obstructed.

7 Claims, 3 Drawing Sheets

VEHICLE DOOR LATCH

This invention relates to latches for vehicle doors, particularly for light passenger and goods vehicles.

Most mass produced light vehicles have doors which must be closed manually to latch them shut by self-engagement of latch mechanism, usually on or in the door, with a striker, usually on the associated door post or frame. Due to the need to compress the weather sealing the door has to be slammed shut with some force to engage the latch positively. If the latch does not engage to keep the door fully closed it will only be latched at its first safety position, with the door slightly ajar, and the slamming process has to be repeated. There is not only substantial wear and tear on the door, door pull, and latch mechanism; there is also the nuisance of the noise particularly at night in residential areas.

Furthermore the development of more effective weathersealing and of variations in door styling and fitting, e.g. to reduce wind noise and/or resistance at speed, has been inhibited by the limitations imposed by the above slam closing.

The object of the invention is to provide improvements in vehicle door latching, in particular the provision of powered latching driving the door to fully closed condition without slamming in an effective, economical and reliable manner.

According to the invention there is provided a vehicle door latch assembly as defined by the claims herein.

Conveniently the closing mechanism is electrically powered, and preferably the assembly will include switch means energising said mechanism automatically in response to shifting of the claw to the outer position on closing of the door to the first safety position, and de-energising the mechanism on sensing that the door has fully closed.

The drive input element may be a lever, conveniently pivoted co-axially with the claw, and carrying the drive pawl on an arm of the lever to engage a ratchet tooth of the claw.

The disabling means may comprise a pawl stop pivoted on the latter lever and coupled to the unlatching means, said stop being shifted to a position at which it holds the drive pawl out of engagement with the claw when the unlatching means disengages the latch pawl from the claw.

Figure 1:
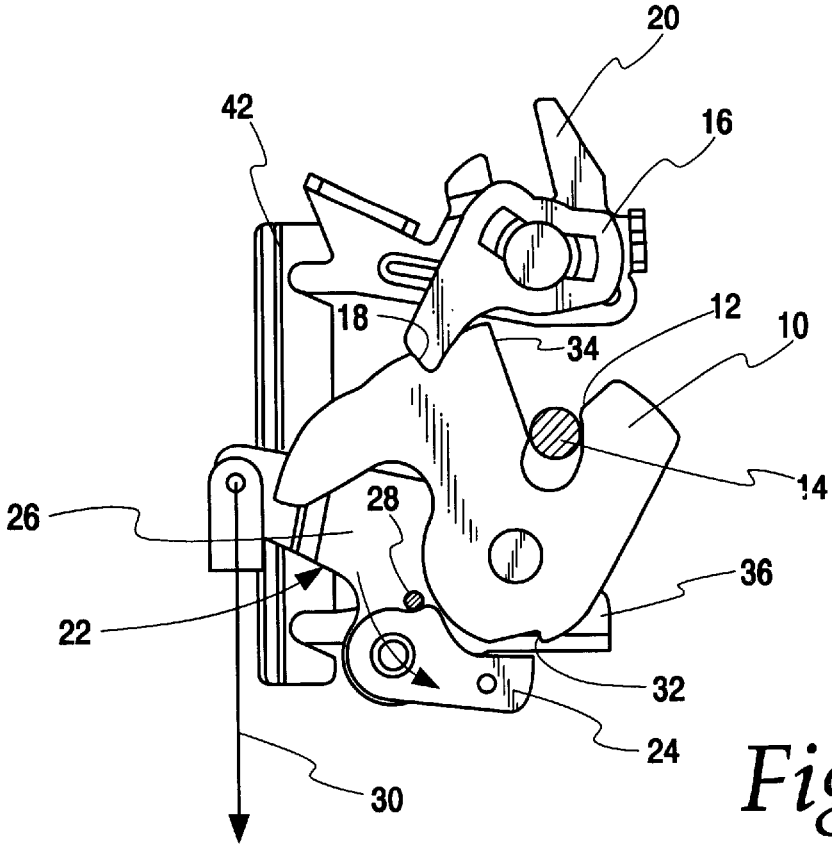
Figure 2:
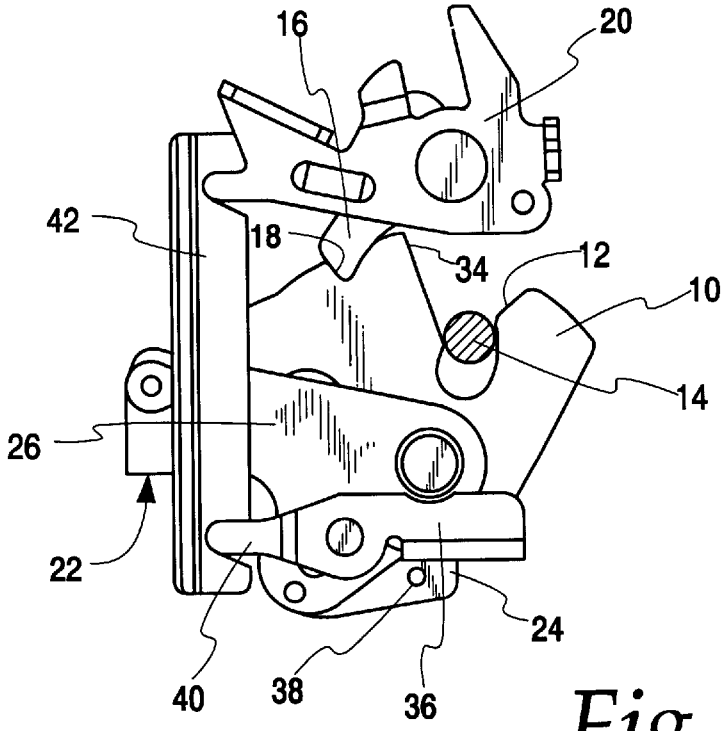
Figure 3:
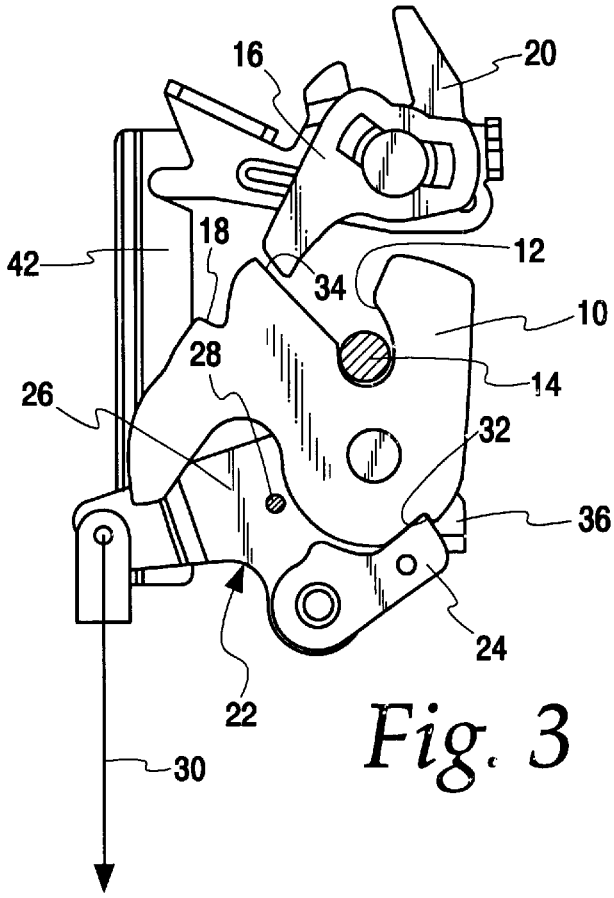
Figure 4:
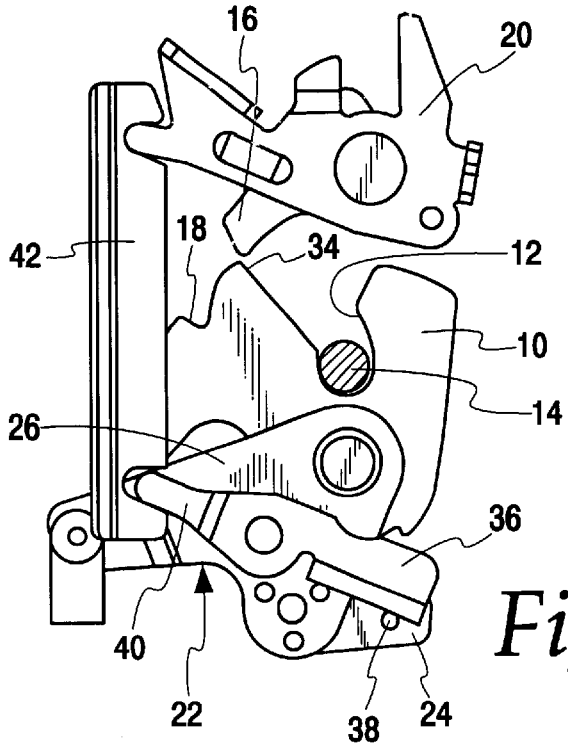
Figure 5:
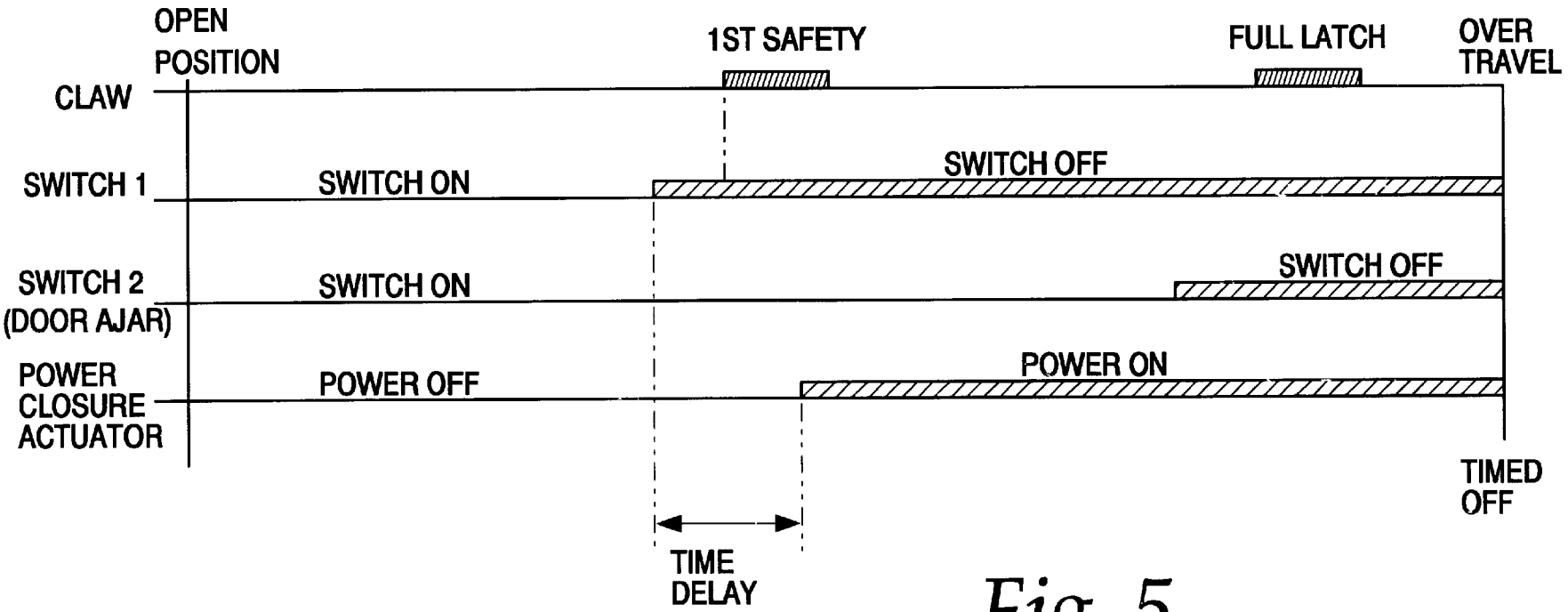

An example of the invention is now more particularly described with reference to the accompanying drawings, wherein;

FIG. 1 is an elevation of parts of a latch assembly with a claw thereof at its outer first safety position, FIG. 2 is an opposite side view (opposite handed) of said parts, FIG. 3 is a elevation as in FIG. 1 but with the claw driven to an inner door fully closed position, FIG. 4 is another opposite side view showing unlatching with disablement of a drive pawl, and FIG. 5 is a diagram of the electrical switching sequence of these parts of the assembly.

Referring firstly to FIGS. 1 and 2, the latch assembly, which will be operatively secured in a door (not shown) in known manner, includes a conventional rotating latch claw 10 having a mouth 12 coacting with a striker 14 operatively mounted to the associated door post (not shown). In those Figures claw 10 is shown at an outer position at which it has been engaged by striker 14 as the door closed to a first safety position at which it is still slightly ajar, with little or no compression of its weather seals, turning claw 10 anticlockwise.

A latching pawl 16 has self-engagement with a ratchet tooth 18 formed as a notch in the upper claw periphery to retain the claw. Unlatching means, operated by the door handles (not shown) is of generally conventional construction and includes a release lever 20 selectively shiftable to free pawl 16 from the claw when the door is to be opened.

Power closing mechanism of the assembly includes a drive input lever 22 pivoted co-axially with claw 10 and carrying a drive pawl 24 pivoted on a leftwardly projecting arm 26 thereof. Lever 22 is shown at its position of rest in FIGS. 1 and 2 with arm 26 raised, in this position pawl 24 is held clear of the claw periphery by a back-stop pin 28, which is fixed relative to the latch assembly, the backstop pin 28 abutting a projection on the upper edge of the pawl.

The distal end of arm 26 is connected by a vertical pull cable 30 to an electric motor drive unit (not shown) through worm and gear or other reduction gearing to give maximum torque converted to rectilinear motion of cable 30.

In operation, when the door has been closed to first safety with claw 10 in the outer position of FIG. 1, switching logic of the assembly energises the drive unit automatically after a time delay, driving arm 26 downwards to the position shown in FIG. 3. As lever 22 turns anti-clockwise, pawl 24 is carried towards the claw periphery, at the same time spacing it from back-stop pin 28. It is free to self engage by being biased into engagement with a drive ratchet tooth 32 in the lower edge of claw 10, so driving the claw further anti-clockwise to the inner position of FIG. 3. Thus the claw 10 co-acts with striker 14 to drive the door to the fully closed position, compressing the weather seals.

Latching pawl 16 engages the left hand top edge of mouth 12, serving as a further ratchet tooth 34, so securing the door closed in conventional manner. As soon as lever 22 has completed its downward power stroke the electrical circuit restores the drive unit to its rest condition and lever 22 is returned to its position of rest as in FIG. 1, back-stop pin ensuring that drive pawl 24 is again disengaged from the claw.

To open the door latching pawl 16 is shifted in known manner by operation of release lever 20, freeing claw 10 to turn clockwise as the door is pushed open.

To ensure that the door can be opened even if power should fail or there should be an electrical malfunction the assembly includes disabling means. As best seen in FIG. 2 input lever arm 26 mounts a rocker lever 36 one arm of which is coextensive with drive pawl 24 and which project above a rearwardly extending pin 38 on that pawl. In normal operation, described above, pin 38 does not contact lever 36. The lefthand tail 40 of rocker lever 36 is connected to an arm of release lever 20 by a rigid vertical link 42.

If the door is closed, i.e. the mechanism is in the FIG. 3 condition, but input lever 22 has failed to return to its rest position drive pawl 24 will remain engaged with tooth 32 which would obstruct clockwise rotation of the claw for opening the door. However, when release lever 20 is operated to disengage latching pawl 16, link 42 is drawn up, rotating rocker lever 36 to the FIG. 4 position and depressing pin 38 to ensure that drive pawl 24 is disengaged.

Various switching logic may be incorporated, one example is shown diagrammatically in FIG. 5. The circuitry may be interconnected with central door locking controls of the vehicle which operate locks of all the doors together. Switch 1 in the diagram senses whether the door is open or closed, being on except when the door is at or near first safety position or inwardly thereof to fully closed. Switch 2 senses whether the door is ajar, i.e. open or at or somewhat inward of first safety, only being off when fully closed. The power closing mechanism is energised by being switched in after a predetermined time delay when the door is swung closed to the first safety position detected by switch 1 and is operated for a timed period sufficient to allow for the necessary inward overtravel of the door against the weather seals which ensures that latching pawl has fully engaged claw 10 at its inward position.

What is claimed is:

1. A vehicle door latch assembly comprising: a pivotally mounted latch claw having a mouth for operatively co-acting with a striker as a door on which the latch assembly is mounted nears a closed position, a latching pawl self-engaging with the claw to hold the claw releasably at an outer position operatively latched to the striker to retain the door at a near-closed first safety position and at an inner position so latched to retain the door at a fully closed position, unlatching means selectively operable to disengage the latching pawl for opening the door, a power closing mechanism operable to turn the claw inwardly from the outer position to engagement with the striker to draw the door to the fully closed position, wherein the power closing mechanism comprises a movable drive input element carrying a drive pawl that is pivotally attached to the drive input element and biased towards an engaged position and which, as said movable drive input element is powered from a position of rest, by reason of being urged in the one pivot direction, engages the claw to turn it from its outer to its inner position, and disabling means linked to the unlatching means and including a disabling formation co-acting with the drive pawl to prevent engagement of the drive pawl with the claw when the latching pawl is disengaged to ensure that the closing mechanism does not obstruct release of the latched door.

2. An assembly as in claim 1 characterised in that the drive input element is a lever (22) carrying the drive pawl (24) on an arm (26) thereof to engage a ratchet tooth (32) of the claw.

3. A vehicle door latch assembly including a pivotally mounted latch claw having a mouth operatively co-acting with a striker as a door nears its closed position, a latching pawl self-engaging with the claw to hold it releasably at an outer position operatively latched to the striker to retain the door at a near-closed first safety position and at an inner position so latched to retain the door at a fully closed position, unlatching means selectively operable to disengage the latching pawl for opening the door, and power closing mechanism operable to turn the claw inwardly from the outer position to engagement with the striker to draw the door to the fully closed position, wherein the power closing mechanism comprises a movable drive input element carrying a drive pawl which, as said element is powered from its position of rest, self-engages the claw to turn it from its outer to its inner position, and disabling means linked to the unlatching means and including a disabling formation co-acting with the drive pawl to prevent engagement of the latter with the claw when the latching pawl is disengaged to ensure that the closing mechanism does not obstruct release of the latched door, wherein the drive input element is a lever carrying the drive pawl on an arm thereof to engage a ratchet tooth of the claw, wherein the lever is pivoted co-axially with the claw.

4. A vehicle door latch assembly including a pivotally mounted latch claw having a mouth operatively co-acting with a striker as a door on which the latch assembly is mounted nears its closed position, a latching pawl self-engaging with the claw to hold it releasably at an outer position operatively latched to the striker to retain the door at a near-closed first safety position and at an inner position so latched to retain the door at a fully closed position, unlatching means selectively operable to disengage the latching pawl for opening the door, and power closing mechanism operable to turn the claw inwardly from the outer position to engagement with the striker to draw the door to the fully closed position, wherein the power closing mechanism comprises a movable drive input element carrying a drive pawl which, as said element is powered from its position of rest, self-engages the claw to turn it from its outer to its inner position, and disabling means linked to the unlatching means and including a disabling formation co-acting with the drive pawl to prevent engagement of the latter with the claw when the latching pawl is disengaged to ensure that the closing mechanism does not obstruct release of the latched door, wherein the drive input element is a lever carrying the drive pawl on an arm thereof to engage a ratchet tooth of the claw, wherein the disabling formation is a rocker lever pivoted on said lever and coupled to the unlatching means, said rocker lever being shifted to a position at which it holds the drive pawl out of engagement with the claw when the unlatching means disengage the latch pawl form the claw.

5. An assembly as in claim 1 characterised in that the closing mechanism (22,24) is electrically powered.

6. An assembly as in claim 5 characterised in that it includes switch means energising said mechanism (22,24) automatically in response to shifting of the claw (10) to the outer position on closure of the door to the first safety position.

7. An assembly as in claim 6 characterised in that said switch means further operates to de-energize the mechanism (22,24) in response to latching of the door at the fully closed position.

* * * * *